United States Patent [19]

Fischer

[11] 4,367,678

[45] * Jan. 11, 1983

[54] OFFSET PRINTING MACHINE DIFFERENTIAL SPEED INKING SYSTEM

[75] Inventor: Hermann Fischer, Augsburg, Fed. Rep. of Germany

[73] Assignee: M.A.N.-ROLAND Druckmaschinen Aktiengesellschaft, Offenbach am Main, Fed. Rep. of Germany

[ * ] Notice: The portion of the term of this patent subsequent to Mar. 16, 1999, has been disclaimed.

[21] Appl. No.: 186,439

[22] Filed: Sep. 12, 1980

[30] Foreign Application Priority Data

Oct. 23, 1979 [DE] Fed. Rep. of Germany ..... 2942733

[51] Int. Cl.[3] ..... B41F 31/10

[52] U.S. Cl. ..... 101/350

[58] Field of Search ..... 101/147, 148, 349, 350, 101/351, 352, 363, 364, 340, 341, 344, 345, 355–357, 360, 361, 204, 205, 206–210, 342, 343, 346, 348, 353, 354, 358, 359; 118/262, 258

[56] References Cited

U.S. PATENT DOCUMENTS

| | | | |
|---|---|---|---|
| 2,821,133 | 1/1958 | Brodie | 101/141 |
| 3,150,589 | 9/1964 | Senogles | 101/350 |
| 4,000,691 | 1/1977 | Fischer | 101/350 |
| 4,129,077 | 12/1978 | Fischer | 101/350 |

*Primary Examiner*—J. Reed Fisher

*Attorney, Agent, or Firm*—Frishauf, Holtz, Goodman & Woodward

[57] ABSTRACT

To permit selective operation of an ink supply as a continuous film inking system, or as an intermittent lifter ink system, with low ink supply operating speeds, the ink distribution rollers (2–6; 8–11, 18) of the ink roller distribution train are divided into two groups (A, B) which are separated from each other by a gap. The gap may be narrow 0.05 mm wide, permitting operation of the rollers of one group (A) at a speed which is about half the circumferential speed of the rollers of the other group (B) and in contact with the plate cylinder (1) of the machine; or the gap may be wider, for example 3 mm or more, and bridged by a roller system in which a plurality of roller elements (13) are retained in a cage (7), with two rollers (14, 15) of larger diameter projecting from the cage for frictional engagement with adjacent rollers of the two groups of the distribution rollers operating at different speeds. The arrangement permits selective operation of the plate cylinder at higher than previously possible speeds without splashing or spraying of water-ink emulsion off rollers of the inking system upon printing on plate carriers of substantially smaller format than the plate cylinders, leaving unused ink-water emulsion on the roller.

10 Claims, 3 Drawing Figures

OFFSET PRINTING MACHINE DIFFERENTIAL SPEED INKING SYSTEM

The present invention relates to offset printing machines, and more particularly to the inking system of rotary offset printing machines having a plurality of rollers, some of which are driven, for example a duct roller, an ink transfer roller which may be a lifter or ductor roller, ink distribution rollers, one or more of which may be oscillating milling rollers, and forme rollers.

Background and Prior Art

Inking systems for offset printing machines can be constructed as film inking systems in which the transfer roller is in continuous ink transfer relationship with the duct roller, receiving ink from an ink trough or the like, or as lifter-type inking systems in which the transfer roller is constructed in form an intermittently engageable roller with, respectively, the ductor roller and the next adjacent roller of the ink distribution roller system or roller train.

Both types of printing ink supply systems have advantages and disadvantages. Film ink systems generally have the disadvantage that when small formats of paper are to be handled, for example in sheet printing machines if the sheets extend only over a portion of the length and width of the plate cylinder, or on narrow webs on rotary continuous web printing machines, that damping liquid applied to the plate cylinder and re-transported into the ink supply system will be distributed over the entire width of the ink rollers, that is, in the range where printing is to be effected as well as on the additional width of the printing rollers, where no paper will be placed. In these edge zones, in which there is no paper, an excess of water will occur which, particularly at the edge regions, will lead to formation of an emulsion of water-ink with increased and possibly excessively high proportion of water. This, in printing, generally leads to striping, uneven inking and streaking. Further, excessively saturated ink-water emulsion may spray off at the edge zones due to centrifugal force.

Lifting roller systems have the disadvantage that the intermittent engagement of the ductor roller with the ink duct roller requires, necessarily, transfer of a relatively thick stripe of ink. It is difficult to distribute this stripe of ink in the inking roller system in such a way that, by successive splitting of the thickness of this stripe of ink, the eventual application of ink to the plate cylinder no longer permits recognition of the intermittent application of ink. The milling of the stripe thus must be carried out through a large number of distribution rollers to provide numerous splitting engagement lines between rollers. This arrangement, therefore, substantially increases the cost, space, and power consumption of such a printing press since many splitting and distribution lines of engaging rollers must be provided. Additionally, the numerous engagement lines of the distribution rollers do not permit rapid response of the ink supply to changes in ink requirement. The overall system thus has a high degree of inertia to changing conditions.

Some systems have been proposed in which the ink supply system permits change-over between operation as a: film ink supply system or as a lifter ink supply system, in dependence on the subject matter to be printed, or the format of paper which is to be handled by the printing machine (see German Patent DE-PS 27 03 424).

Ink supply systems using a lifter roller have the additional disadvantage with respect to film ink systems that they cannot be used for printing at any speed. At high speeds, it is difficult to so increase the lifting frequency of the lifting roller that variations in ink supply, due to the lifting roller operation, are essentially eliminated. Due to the mechanical constraints of the lifting roller system, a circumferential speed of 6 m/sec of the plate cylinder is currently the approximate upper limit of speed with which lifting roller systems can be used.

The Invention

It is an object to provide an inking system which permits higher speed printing than currently available systems, and which has improved printing results.

Briefly, an inking system is provided which, selectively, can be used as a film inking system to apply a continuous film of ink to a transfer cylinder, or as a lifter inking system in which a lifter or ductor roller intermittently applies ink to a transfer cylinder. In accordance with the invention, the ink distribution rollers of the subsequent ink distribution roller system are divided into two groups. The rollers of the group closest to the ink supply are driven at a circumferential speed which is substantially less than the circumferential speed of the distribution rollers of the other group, which are in contact with the plate cylinder. The speed difference may be such that the rollers of the first group are driven at a circumferential speed of about half the speed of the rollers of the second group. A gap is left between adjacent rollers of the two groups which rotate at the respectively substantially different speeds. This gap may, for example, be in the order of about 0.05 mm width; or it may be substantially wider, for example 3 mm or more, and then this gap can be bridged by a roller systems in which the individual roller elements have floating centers and are retained within a cage structure, the roller elements themselves being, for example, in the form of balls, pin-type rollers, or the like, which have an ink accepting surface.

The arrangement in accordance with the invention, in which the distribution rollers are divided into two groups rotating at substantially different circumferential speeds, has the advantage that, when the inking system itself is changed over between a film inking system or a lifter-type inking system, the lifter frequency can be placed very high since, if the circumferential speed of the plate cylinder exceeds 6 m/sec, the lifter will operate intermittently only if comparatively little ink is required. Thus, since the quantity of ink required to be delivered by the inking system then will be low, striping due to intermittent lifter operation will not be visible. The lifter permits re-transport of ink-water mixture or emulsion to the ink trough, thus preventing the formation of undesirable accumulations or pools of emulsion at localized positions.

In accordance with a preferred feature of the invention, the system is so arranged that is can operate in either direction of rotation, while permitting the advantages of the lifter roller system even at high circumferential operating speeds of above 6 m/sec, where the advantages of the lifter systems still can be fully realized.

The arrangement has the additional advantage that it permits operation of the duct roller at a speed which is not substantially less than the speed of the ink transfer roller, so that the difference in speed is less than in customarily known inking systems, thus permitting better distribution of the ink through the ink distribution roller system of the printing machine.

DRAWINGS

Figure 1:
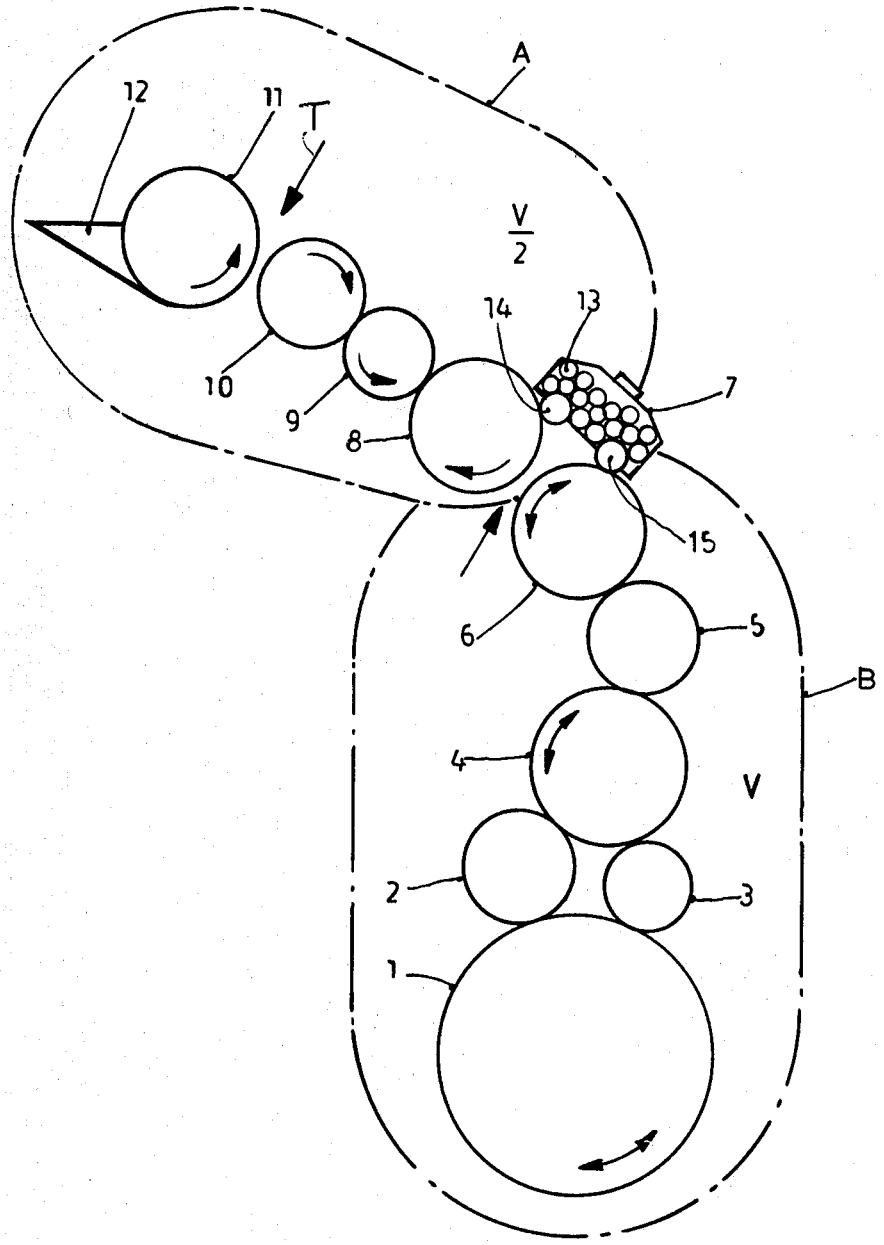
FIG. 1 is a highly schematic side view of an inking system operating as a film ink supply system.

A plate cylinder 1 is inked by the inking system which applies ink over two forme rollers 2, 3 thereto. The forme rollers receive ink from an oscillating milling roller 4, two further distribution rollers 5, 6, distribution rollers 8, 9 including, ink transfer rollers 10, and an ink duct roller 11 in ink transfer communication with an ink trough 12.

The distribution and transfer rollers are subdivided into two groups, A and B. The rollers of the respective groups are driven with differential circumferential speeds. The rollers 2–6 of group B operate at the higher speed V, which corresponds to the circumferential speed of the plate cylinder 1. The rollers 8–11, forming the rollers of group A, are driven at a substantially lower speed. A typical speed is, for example, V/2 for the rollers 8–10; an even lower speed can be used for the ink duct roller 11, which can be driven at a circumferential speed somewhat less, for example slightly less, e.g. by about 10%, of the circumferential speed of rollers 8–10.

The immediately adjacent rollers 6, 8 of the two groups A and B are separated from each other by a gap of at least 3 mm. To provided for ink transfer between the rollers 8 and 6 of the distribution roller system or roller train, an ink transfer apparatus 7 is placed in ink transfer relation on the rollers 6 and 8.

In accordance with a feature of the invention, the ink transfer apparatus 7 is a cage which retains a plurality of roller elements 13 therein, located in centerless, floating center relationship within the cage. The roller elements 13 may be balls, pins, cylindrical elements, or the like. They are located adjacent each other and above each other, for example in random configuration as shown in FIG. 1, or, if the in the form of pins or cylindrical elements, loosely guided for floating center adjustment in the side walls of the cage 7. Two rollers of larger diameter than the roller elements 13 extend from the bottom wall of the cage 7. These rollers 14, 15 are in respective surface contact and frictional engagement with the rollers 8, 6 of the roller groups A and B. Rotation of the respective rollers 6, 8 turns the rollers 15, 14, by surface-frictional engagement.

The rollers 14, 15, as well as all the roller elements 13 within the cage 7, are driven solely by surface-frictional engagement. The roller elements 13 and the rollers 14, 15 have a surface which is ink accepting. The side walls of the cage 7 provide sufficient lateral guidance for the various roller elements. Provision of separate bearings for the roller elements 13 thus is not needed; the rollers 14, 15 may be loosely guided in suitable receptacles within the side wall of the cage 7, but need not be retained in fixed bearings. Preferably, an even number of roller elements 13 is positioned between the rollers 14, 15.

Any types of roller elements 13 having circular diameter are suitable, such as balls, or cylindrical elements.

Operation: The distribution rollers 6, 8 are separated by a gap which is sufficiently wide to inhibit transport of ink, and ink-water emulsion as well between the rollers 6 and 8. The cage 7, with the rollers 14, 15 and the roller elements 13 therein, provides for ink transport from the distribution rollers of group A, that is, from the distribution roller 8 to the distribution rollers of group B, that is, to distribution roller 6. The rollers within the cage 7 can rotate in either direction; the arrangement is insensitive to the direction of rotation, and to speed; the rollers 2–6 of group B, and the plate cylinder, thus may operate at any desired speed and in either direction of rotation.

Figure 2:
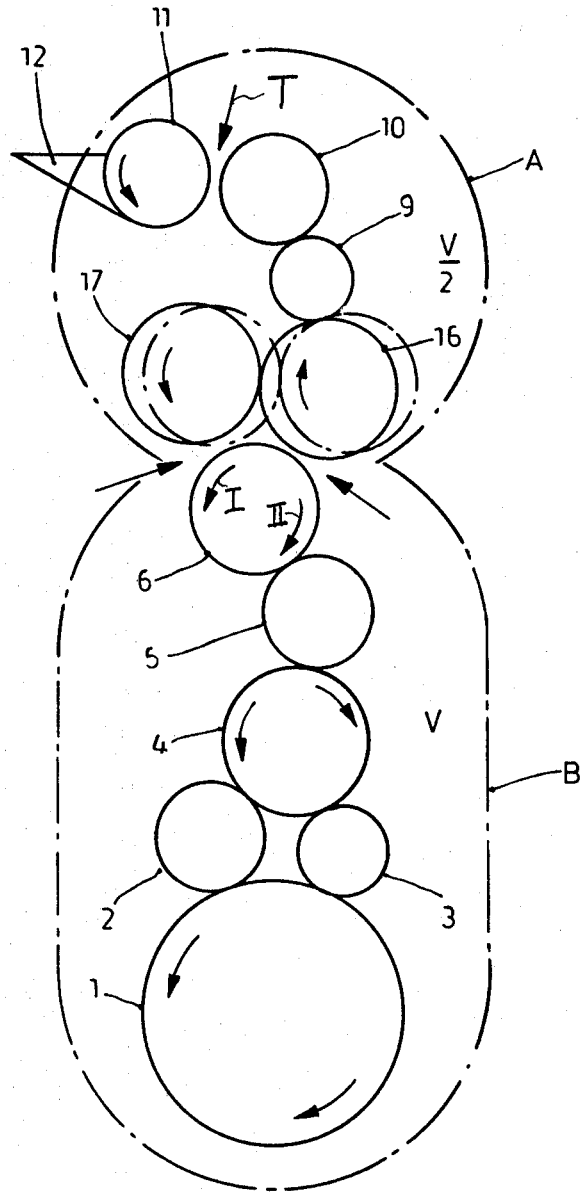
FIG. 2 is a highly schematic side view of another embodiment of a film ink supply system which is bi-directionally operable.

Embodiment of FIG. 2: Those portions of the system which are identical have been given the same reference numerals and will not be described again; rather than providing a gap between the roller of the group A adjacent the roller 6 of group B which is wide enough so that it has to be bridged by the cage 7, the gap between roller 6 and the next adjacent roller of group A is made small, for example of approximately 0.05 mm. This narrow gap can be bridged by an ink film, yet it permits operating the rollers of group A at a speed V/2 which is about half the speed V—taken in circumferential direction—of the rollers of group B. This substantial difference in speed permits transfer of an adequate amount of ink from either roller 16 of the distribution group A or of roller 17 thereof. Rollers 16 or 17 are selectively engaged, depending on the direction of rotation of the plate cylinder 1. In order to render the system directionally independent, and when the distribution roller 6 is operating in the direction of the arrow I—as illustrated in the solid-line positions of rollers 16, 17—roller 16 will transfer ink from distribution roller 9 of the group A to the roller 6 of the group B, and roller 17 will act as an idler or freely riding roller element, contributing to further ink distribution. Upon reversal of the direction of rotation of the plate cylinder 1, and hence of the roller 6, the roller 17 is introduced into the transfer path of ink, so that ink will be transmitted from the transfer roller 10 over distribution roller 9 to roller 16, positioned in the chain-dotted line location as shown in FIG. 2, to then transfer ink to roller 17 which, likewise, will be in the chain-dotted position and in circumferential engagement with the distribution roller 6 of group B. Thus, roller 17 will then act as an ink distribution roller which transfers ink, rather than as a distribution floating roller.

Figure 3:
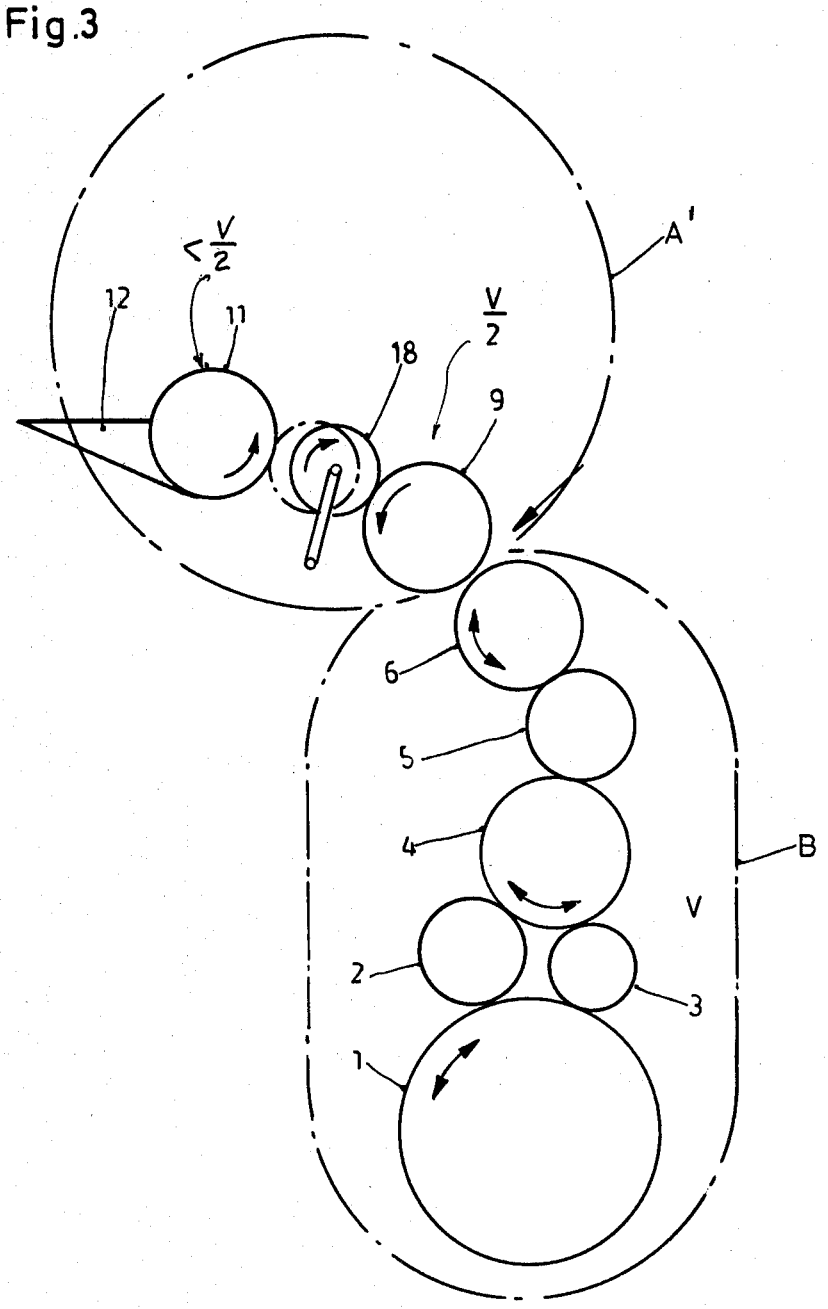
FIG. 3 is a highly schematic side view of an ink supply system using a lifter roller.

The ink supply systems of FIGS. 1 and 2 are film ink systems, in which a thin film of ink is transferred between duct roller 11 and transfer roller 10 as well known, and schematically merely indicated by the arrow T. In FIG. 3, a lifter roller 18 is used instead of the transfer roller 10 to apply ink to the distribution roller 9 of the distribution roller trains.

Embodiment of FIG. 3: The roller group A has been replaced by the roller group A'; alternatively, a selectively engageable film-or-lifter system, as known and as described in German Patent DE-PS 27 03 424, may be used, having the selective operating effect of either the embodiments shown in FIGS. 1 and 2 or FIG. 3, that is, permitting switch-over from film operation (FIGS. 1, 2) to lifter operation (FIG. 3). The lifter roller 18, as such, can operate in accordance with well known and standard operating principles.

The system then will permit flexibility of printing and selection, by the printer, of the most suitable ink supply in dependence on speed of printing, and type and size of the material on which printing is to be effected; and, if desired, permit changeover between film inking mode of operation and lifter ink supply. The printer, thus, has the opportunity to control the supply of ink for optimum operating conditions in dependence on subject matter or other printing requirements.

I claim:

1. In a rotary offset printing machine comprising a plate cylinder (1), an inking system having an ink supply means (12);

a duct roller (11) in ink receiving relation to the ink supply means;

a plurality of ink distribution and transfer rollers (3–6; 8, 9, 10) forming an ink roller train and positioned in mutually ink-transferring relation, located between the ink duct roller and the plate cylinder, and wherein, the ink distribution and transfer rollers are divided into two groups (A,B) positioned adjacent each other in the direction of ink transfer, the rollers (8, 9) of one of the groups (A) being driven at a circumferential speed which is substantially less than the speed of the rollers (2-6) of the other group (B);

wherein a gap is placed between a terminal roller (8) of one group (A) and a terminal roller (6) of the other group (B) which is adjacent the terminal roller (8) of the first group (A) and is in ink transferring relation thereto, to separate adjacent rollers of the two groups rotating at said substantially different speeds, said gap being wider than the thickness of ink film being transferred;

and wherein a bridging element (7) is provided comprising a cage-like holder (7), two rollers (14,15) projecting from said cage-like holder in surface contact with the respective terminal rollers (8, 6) of said two groups (A, B) of distribution and transfer rollers, and a plurality of roller elements (13) in said cage-like holder having circular cross section and ink-receiving surfaces, said roller elements (13) being loosely placed in centerless floating arrangement, randomly positioned horizontally and vertically adjacent each other and selectively adjacent the two rollers (14,15) projecting from said cage-like holder, said cage-like holder being positioned to span said gap between the terminal rollers (6, 8) of said groups, rotation of the respective terminal distribution and transfer roller of the respective group rotating the respective projecting roller (14, 15) in the cage-roller elements (13) retained therein.

2. System according to claim 1, wherein the rollers (14, 15) projecting from the cage (7) have a greater diameter than the roller elements (13) within the cage-like holder (7).

3. System according to claim 1, wherein an even number of roller elements (13) is positioned between the rollers (14, 15) projecting from the cage-like holder (7).

4. System according to claim 1, wherein (FIGS. 1, 2) the ink supply means (12), the duct roller (11), and one of the ink distribution and transfer rollers form a film ink supply system operating at said substantially slower circumferential speed.

5. System according to claim 1, wherein (FIG. 3) the inking system comprises an intermittently engageable lifter roller (18), intermittently transferring ink from the ink duct roller (11) to one of the ink distribution and transfer rollers (9) of said group (A) of distribution rollers operating at the substantially slower speed.

6. System according to claim 1, wherein (FIGS. 1 and 2; or FIG. 3) one (10, 18) of the ink distribution and transfer rollers (10, 18) is operable in continuous engagement with another one roller (9) of the ink distribution and transfer rollers of the group (A) which operates at said substantially slower speed, and selectively operable in continuous or intermittent engagement between said duct roller (11) and said another one roller (9) of the distribution and transfer rollers to form selectively, a film, or a lifter transfer roller.

7. System according to claim 1, wherein the terminal ink distribution and transfer rollers (6, 8) of the groups (A, B) positioned with said gap therebetween have a hard surface.

8. System according to claim 7, wherein said hard surface is a metallic surface.

9. System according to claim 1, wherein the circumferential speed relationship of said groups (A, B) of ink distribution and transfer rollers is approximately 1:2.

10. System according to claim 9, wherein the duct roller (11) is driven at a circumferential speed which is somewhat less than the circumferential speed of the transfer distribution and roller (10, 18) of said one group.

* * * * *